United States Patent [19]

Meinzer

[11] 4,407,484

[45] Oct. 4, 1983

[54] IMPACT ENERGY ABSORBER

[75] Inventor: Jan N. Meinzer, Sacramento, Calif.

[73] Assignee: Meinco Mfg. Co., Sacramento, Calif.

[21] Appl. No.: 321,339

[22] Filed: Nov. 16, 1981

[51] Int. Cl.[3] ..... A01K 3/00; E01F 15/00

[52] U.S. Cl. ..... 256/13.1; 104/256; 404/6; 114/219

[58] Field of Search ..... 256/13.1, 1 R; 404/6, 404/9; 104/254, 255, 256; 188/290, 293; 114/219; 267/8 R

[56] References Cited

U.S. PATENT DOCUMENTS

| | | | |
|---|---|---|---|
| 1,740,027 | 12/1929 | Libani | 188/290 |
| 3,503,600 | 3/1970 | Rich | 256/13.1 X |
| 3,545,802 | 12/1970 | Rich | 256/13.1 X |
| 3,643,924 | 2/1972 | Fitch | 256/13.1 X |
| 3,674,115 | 7/1972 | Young et al. | 256/13.1 X |
| 3,680,662 | 8/1972 | Walker et al. | 104/256 X |
| 3,799,064 | 3/1974 | Kikuchi et al. | 104/256 |
| 3,944,187 | 3/1976 | Walker | 256/13.1 X |
| 3,982,734 | 9/1976 | Walker | 256/13.1 X |
| 4,118,014 | 10/1978 | Frosch et al. | 256/13.1 X |
| 4,345,537 | 8/1982 | Ueda et al. | 114/219 |

*Primary Examiner*—Wayne L. Shedd
*Attorney, Agent, or Firm*—Lothrop & West

[57] ABSTRACT

An impact energy attenuator has a housing in front of a roadway abutment. A leading nose piece and a number of impact walls can move toward and away from the abutment. Coil springs urge the nose piece, the several impact walls, and the housing apart. A cable attached to the nose piece is wound around a drum and is spring tensioned to rotate the drum in a take-up direction. Rotation of the drum in the opposite direction is inhibited by a hydraulic pump discharging through a restricted orifice.

9 Claims, 5 Drawing Figures

IMPACT ENERGY ABSORBER

BRIEF SUMMARY OF THE INVENTION

An impact energy attenuator especially for use adjacent an abutment upstanding from a roadway has a housing in front of the abutment. Rails on the ground are disposed in front of the housing and support a leading nose piece and a number of intermediate impact walls for movement toward and away from the abutment. There are springs interposed between the nose piece, the several impact walls and the housing to urge them apart. A cable attached to the nose piece is wound around a drum mounted in the housing and normally is kept taut by a spring tending to rotate the drum in one direction. Rotation of the drum in the opposite direction is inhibited by a connected hydraulic pump discharging through a restricted orifice.

DETAILED DESCRIPTION

Figure 1:
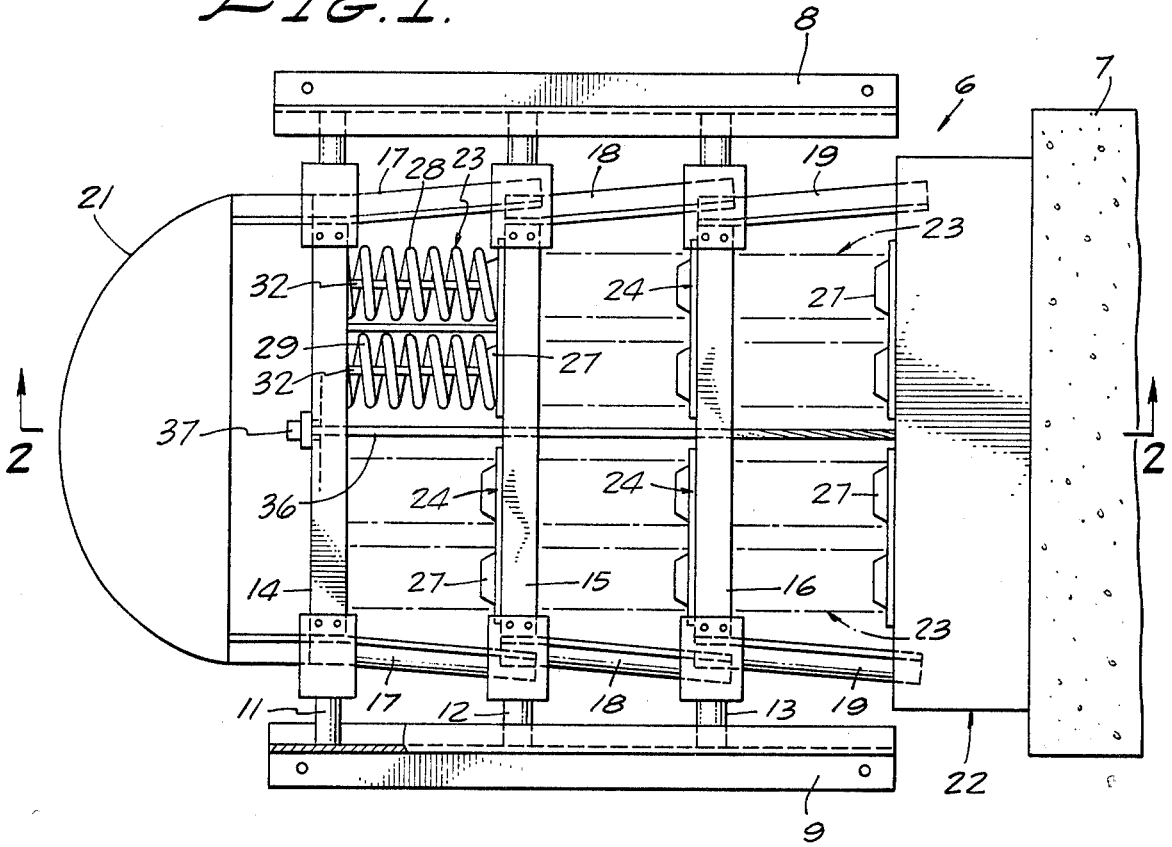
FIG. 1 is a plan, somewhat diagrammatic, of a device constructed pursuant to the invention shown in its normal, extended position.
Figure 2:
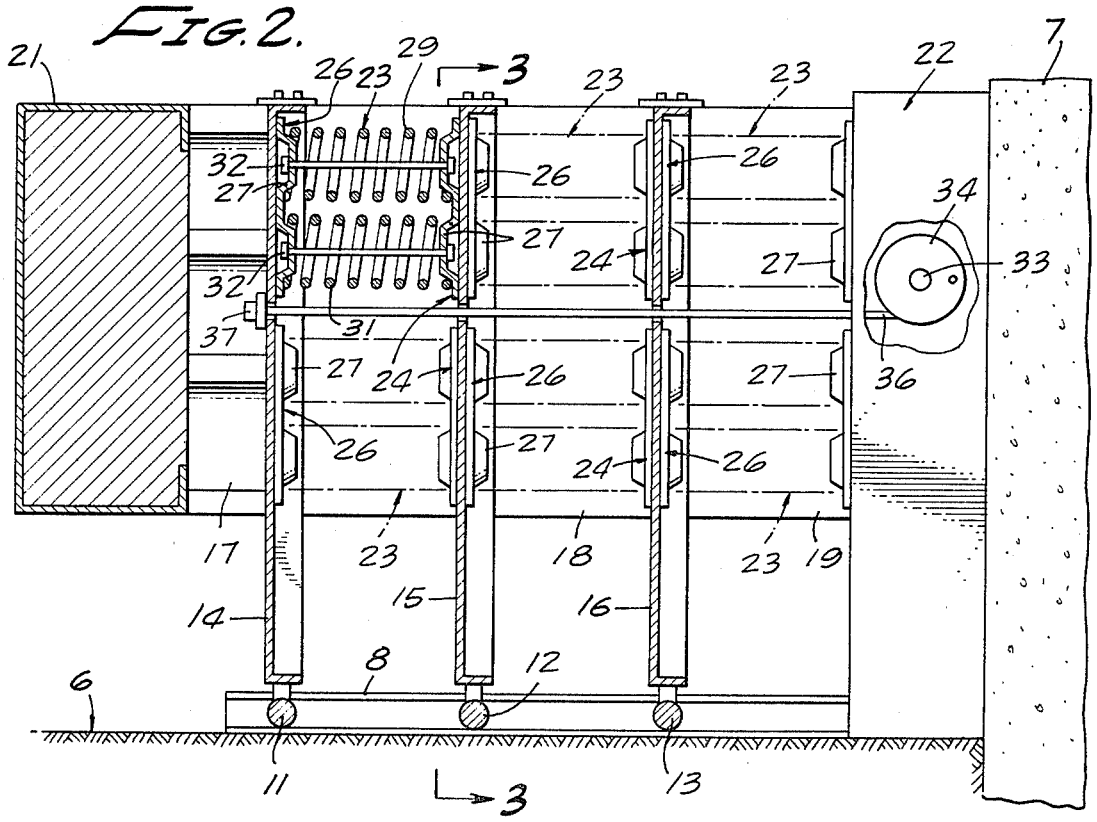
FIG. 2 is a cross-section, the plane of which is indicated by the line 2—2 of FIG. 1.
Figure 3:
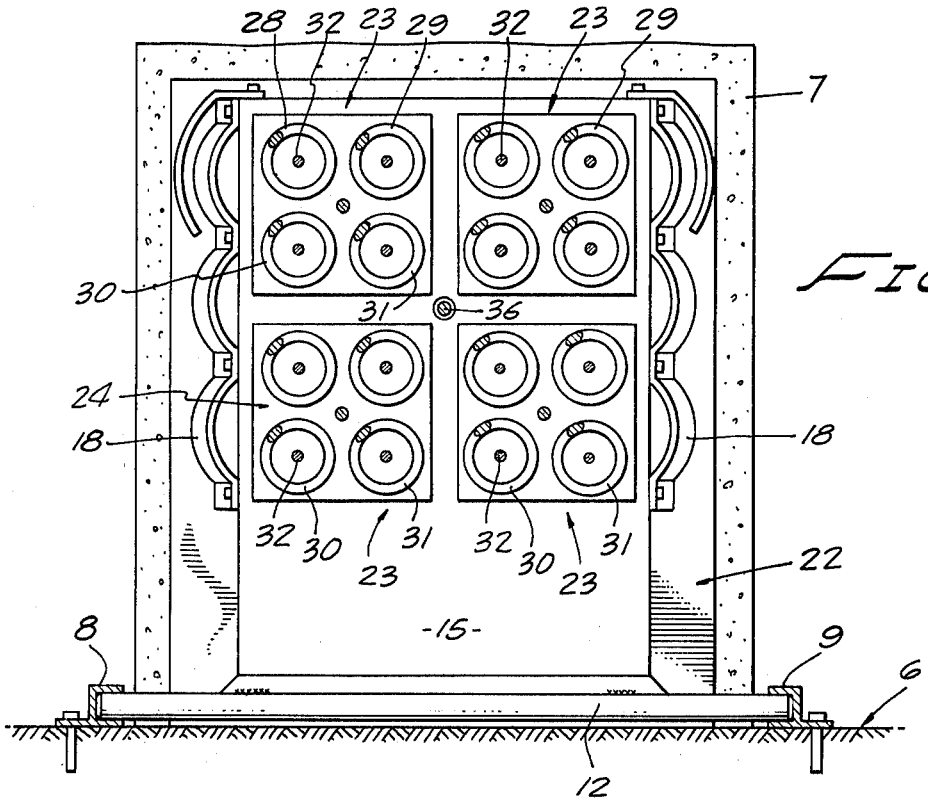
FIG. 3 is a cross-section, the plane of which is indicated by the line 3—3 of FIG. 2.

In accordance with the present invention, the structure is designed to alleviate much of the difficulty arising out of crashes that occur on roadways in the vicinity of abutments and upstanding obstacles. In the present instance, the roadway 6 extends forwardly of an upstanding or upright abutment 7 such as a concrete support or the like.

Arranged in front of the abutment parallel to the direction of advancing traffic are guide rails 8 and 9 spaced apart in order to support a number of cross rods 11, 12 and 13, for example. These cross rods are confined by the rails 8 and 9 except for movement longitudinally of the rails. The cross rods serve as supports for transverse impact walls 14, 15 and 16 generally upstanding and at their ends carrying pairs of side walls 17, 18 and 19. These are disposed opposite each other with respect to the center line and preferably are somewhat overlapped. These side walls are preferably made of horizontally corrugated stock and thus interfit and partially overlap to aid in guiding each other for movement toward and away from the abutment 7.

The leading impact wall 14 has a forward extension providing a nose piece 21. This is preferably of some sort of absorbent or accommodating material so that a vehicle, for example, impacting against the nose piece has some cushioning.

The normal spacing of the impact walls 14, 15 and 16 from each other and from the abutment 7 is provided in part by a housing 22 of conveniently rectangular form disposed immediately in advance of the abutment 7 and serving as a mounting for a number of spring bundles 23. Each spring bundle preferably includes a pair of plates 24 and 26 having a number of spring cups 27 embossed therein. The cups serve as positioners and mounts for intervening coil springs 28, 29, 30 and 31. The springs in the normal released condition are given a slight initial compression and are prevented from expanding unduly by a central tie 32 passing through each adjacent pair of cups and serving as a limit stop therefor.

Conveniently, the number of springs varies with the design characteristics and performance requirements of an individual attenuator, but in the present instance there are twelve spring bundles 23 all substantially alike. These spring bundles when in normal or released or relaxed position maintain the impact walls 14, 15 and 16 spaced apart longitudinally and from the housing 22. They also maintain the nose piece 21 well in advance of the remaining portion of the structure.

Figure 4:
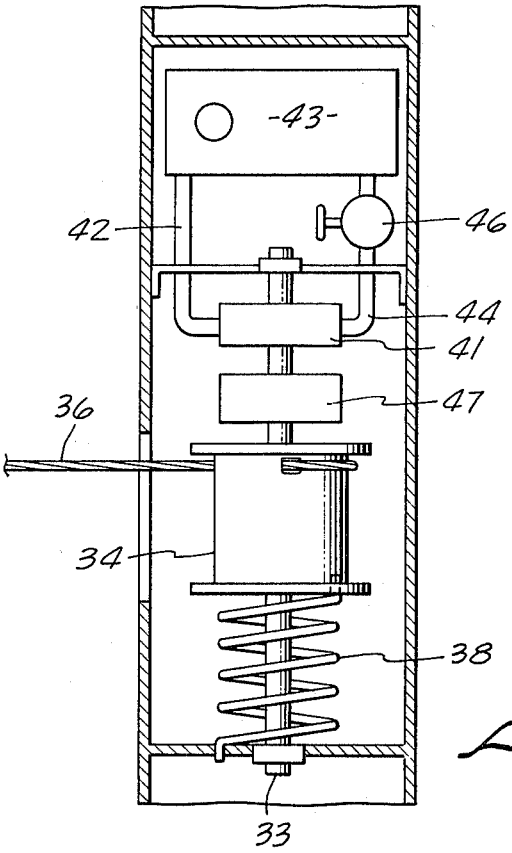
FIG. 4 is a plan of a housing showing the spring drum and hydraulic mechanism installed therein.

Particularly pursuant to the invention, there is provided within the housing 22, and as especially shown in FIG. 4, a rotatable shaft 33 journalled to turn about a transverse horizontal axis and carrying a drum 34 fixed thereto. A main cable 36 at one end is fastened to the drum 34, is reeled around the drum, and passes through the housing wall and through the impact walls 15 and 16 and has a fastener 37 at the forward impact wall 14. The cable 36 is kept taut because the drum tends to be rotated by a coil drum spring 38 at one end anchored in the housing or casing 22 and at the other end secured to the drum 34. The effect of the drum spring is to tend to wind the cable 36 onto the drum, but the drum spring force is too small normally to move the impact wall 14 against the customary resistance of the wall.

Also disposed on the drum shaft 33 and adapted to be driven thereby is a hydraulic pump 41 having an inlet conduit 42 extending from a reservoir tank 43 and likewise having an outlet conduit 44 extending through an adjustable restrictor valve 46 back to the tank. The arrangement is that the pump is driven by the drum 34, but there is preferably an intervening, one-way clutch 47 in the shaft 33 between the drum and the pump so that the pump is driven and provides a load or resistance in one direction of rotation of the drum only.

Figure 5:
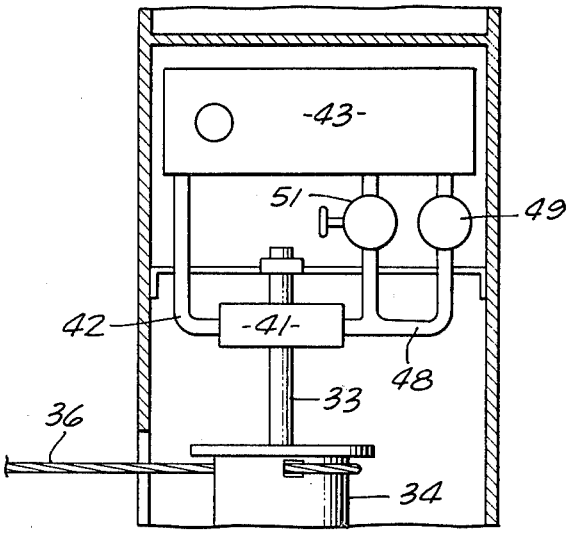
FIG. 5 is a view comparable to a portion of FIG. 4 but showing an alternative arrangement.

As an alternative arrangement, as shown in FIG. 5, the parts are substantially the same except that the overrunning or one-way clutch 47 is eliminated and the conduit 44 is altered. In this instance, the discharge from the pump 41 is into a branched conduit 48 extending through a check valve 49 to the tank 43 and extending also through a parallel valve 51 that can be varied in opening. In this arrangement, when the drum 34 revolves in one direction, the pump 41 also revolves in the same direction and discharges against a closed check valve 49 and thus must discharge entirely through the restricting valve 51. On the other hand, when the drum 34 moves in the opposite direction and the pump 41 turns oppositely, then the check valve 49 opens and flow is freely from the tank 43 through the check valve to the pump 41 without substantial restriction.

In general operation, this structure normally reposes substantially as illustrated in the drawings. When, however, there is a severe impact on the nose piece 21, for example, the nose piece is driven toward the upright abutment 7. The nose piece and the impact wall 14 together with the intervening impact walls 15 and 16 move on their individual cross rods and on the rails 8 and 9 toward the upright abutment 7. In so doing, these various moving parts compress or flex the numerous sets of intermediate springs 28, 29, 30 and 31 from released condition toward an energy absorbing condition to absorb the impact energy. At the same time, the cable 36 is relieved by the impact wall motion so that the drum spring 38 is effective to rotate the shaft 33 and wind the newly available cable 36 onto the drum 34. While this rotation is going on, the pump 41 would likewise be revolving, except that the overrunning clutch 47 (FIG. 4) is released, so no hydraulic flow occurs. In the FIG. 5 version, while the drum 34 and the pump 41 rotate together, fluid flow is through the open check valve 49 and is substantially without resistance.

When the entire assemblage has been compressed as much as required and has absorbed substantially all of the impact energy, then the bundles of springs 28, 29, 30 and 31 all tend to expand toward relaxed condition and to impose an expanding or separating force upon the intervening impact walls 15 and 16 and particularly upon the impact wall 14. This impact wall 14 tends to return toward its initial position and in so doing tensions the main cable 36 and so rotates the drum 34. In this direction of rotation of the drum, the one-way clutch 47 of FIG. 4 engages and causes the pump 41 to function to discharge liquid through the restricting valve 46. This imposed a substantial load or resistance on rotation of the shaft 33, so that the compact walls can return only slowly or at a controlled rate toward their original positions. Similarly, when the same drum rotation occurs in the FIG. 5 version, the pump 41 discharges fluid through the restricted valve 51 and thus controls the return movement of the impact walls toward their initial positions.

In either instance, the arrangement is such that even though substantial energy has been absorbed from an impact or crash, the absorbed energy is dissipated in a controlled manner partially as heat by pumping the hydraulic fluid and partly in friction by restoring the movable parts at least partially toward their initial positions.

I claim:

1. An impact attenuating device comprising a stationary housing having an upright wall, a guide rail extending between a location adjacent said upright wall and another location distant from said upright wall, an impact wall, means movably mounting said impact wall on said rail to travel toward and away from said upright wall, a spring flexable between a relaxed condition and an energy storage condition, means mounting said spring in said relaxed condition between said upright wall and said impact wall, means operated by said impact wall upon travel of said impact wall toward said upright wall flexing said spring from said relaxed condition into said energy storage condition, and means controlling flexing of said spring from said energy storage condition into said relaxed condition.

2. A device as in claim 1 in which said means controlling flexing includes a hydraulic pump, and means restricting hydraulic outflow from said pump.

3. An impact energy attenuator as in claim 1 including means supporting said impact wall to travel parallel to said upright wall.

4. An impact energy attenuator as in claim 1 including a plurality of coil springs disposed between said impact wall and said upright wall, and means including control ties limiting the expansion of each of said springs into said relaxed condition.

5. An impact energy attenuator as in claim 1 in which said means controlling flexing of said spring includes a drum, means mounting said drum for rotating on said upright wall, a cable connecting said impact wall and said drum, a drum spring, and means connecting said drum spring to said drum and to said upright wall and tensioning said cable.

6. An impact energy attenuator as in claim 1 in which said means controlling flexing of said spring includes a drum, means rotating said drum by movement of said impact wall, a hydraulic pump, means connecting said pump and said drum in driving relationship, a hydraulic tank, an inlet from said tank to said pump, an outlet from said pump to said tank, and a restricting valve in said outlet.

7. An impact energy attenuator as in claim 6 including a one-way clutch in said connecting means between said drum and said pump connecting said drum and said pump only when said drum is rotating in a direction to unreel said cable.

8. An impact attenuating device comprising an upright wall stationarily disposed, an impact wall, means mounting said impact wall for movement upon impact toward said upright wall and for movement upon rebound away from said upright wall, a coil spring, means disposing said coil spring against said upright wall and said impact wall for compression as said impact wall moves toward said upright wall and for relaxation as said impact wall moves away from said upright wall, and means interconnecting said upright wall and said impact wall resisting movement of said impact wall away from said upright wall.

9. A device as in claim 8 in which said resisting means includes a hydraulic pump having an inlet and an outlet, and means restricting said outlet.

* * * * *